US008839876B2

(12) United States Patent
McLoughlin et al.

(10) Patent No.: US 8,839,876 B2
(45) Date of Patent: Sep. 23, 2014

(54) HYDRAULIC SYSTEM AND METHOD FOR DELIVERING ELECTRICITY, WATER, AIR, AND FOAM IN A FIREFIGHTING APPARATUS

(75) Inventors: John E. McLoughlin, Hauppauge, NY (US); Neocles G. Athanasiades, E. Setauket, NY (US); Kiam Meng Toh, Hauppauge, NY (US); James L. Otwell, Cypress, TX (US)

(73) Assignee: ROM Acquisition Corporation, Belton, MO (US)

( * ) Notice: Subject to any disclaimer, the term of this patent is extended or adjusted under 35 U.S.C. 154(b) by 1106 days.

(21) Appl. No.: 12/835,098

(22) Filed: Jul. 13, 2010

(65) Prior Publication Data

US 2012/0012344 A1 Jan. 19, 2012

(51) Int. Cl.

| | |
|---|---|
| ***A62C 35/00*** | (2006.01) |
| ***A62C 2/00*** | (2006.01) |
| ***A62C 37/10*** | (2006.01) |
| ***A62C 27/00*** | (2006.01) |
| ***A62C 99/00*** | (2010.01) |
| *A62C 5/02* | (2006.01) |
| *A62C 5/00* | (2006.01) |
| *A62C 3/07* | (2006.01) |

(52) U.S. Cl.

CPC . *A62C 27/00* (2013.01); *A62C 5/02* (2013.01); *A62C 5/002* (2013.01); *A62C 3/07* (2013.01); *A62C 99/009* (2013.01)

USPC ..... 169/13; 169/14; 169/44; 169/6; 169/45; 169/47; 169/61

(58) Field of Classification Search

CPC ..... A62C 99/009; A62C 27/00; A62C 3/07; A62C 5/002; A62C 5/02; A62C 5/00; B64D 1/18

USPC ..... 169/13, 14, 15, 44, 6, 45, 46, 47, 60, 169/61; 417/26, 313, 199.1, 426; 137/565.29–565.33

See application file for complete search history.

(56) References Cited

U.S. PATENT DOCUMENTS

| | | | | |
|---|---|---|---|---|
| 3,294,105 | A * | 12/1966 | Schaub | 137/110 |
| 4,189,005 | A | 2/1980 | McLoughlin | |
| 4,224,826 | A | 9/1980 | McLoughlin | |
| 4,246,969 | A | 1/1981 | McLoughlin | |

(Continued)

*Primary Examiner* — Jason Boeckmann
*Assistant Examiner* — Steven M Cernoch
(74) *Attorney, Agent, or Firm* — Andrews Kurth LLP

(57) ABSTRACT

A firefighting apparatus comprising a controller, and a hydraulic pump driven by a power-take-off and operable to supply a hydraulic fluid under pressure. A water pumping subsystem is powered by the hydraulic fluid and operable to supply water under pressure to a conduit, wherein a flow rate of water is substantially regulated by controlling the hydraulic fluid input to the water pumping subsystem. A chemical foam subsystem is powered by the hydraulic fluid and operable to inject foam at a predetermined flow rate into the conduit, wherein the flow rate of the foam is substantially regulated by controlling the hydraulic fluid input to the chemical foam subsystem. An electrical power generator subsystem is powered by the hydraulic fluid and operable to generate electrical power, wherein the frequency and voltage of the generated power is substantially regulated by controlling the hydraulic fluid input to the electrical power generator subsystem. A hydraulic fluid cooling device receives and cools the hydraulic fluid returned from the water pumping subsystem, chemical foam subsystem, and electrical power generator subsystem. A hydraulic reservoir further stores the cooled hydraulic fluid.

11 Claims, 4 Drawing Sheets

(56) References Cited

U.S. PATENT DOCUMENTS

| | | | | |
|---|---|---|---|---|
| 4,262,287 | A | 4/1981 | McLoughlin | |
| 4,324,294 | A * | 4/1982 | McLoughlin et al. | 169/13 |
| 4,948,050 | A * | 8/1990 | Picot | 239/171 |
| 4,981,178 | A * | 1/1991 | Bundy | 169/9 |
| 5,096,389 | A * | 3/1992 | Grady | 417/364 |
| 5,113,945 | A * | 5/1992 | Cable | 169/15 |
| 5,145,014 | A * | 9/1992 | Eberhardt | 169/14 |
| 5,494,112 | A * | 2/1996 | Arvidson et al. | 169/13 |
| 5,590,719 | A * | 1/1997 | McLoughlin et al. | 169/70 |
| 5,888,051 | A | 3/1999 | McLoughlin | |
| 6,009,953 | A * | 1/2000 | Laskaris et al. | 169/13 |
| 6,684,959 | B1 * | 2/2004 | Juidici et al. | 169/44 |
| 7,040,868 | B2 * | 5/2006 | McLaughlin et al. | 417/34 |
| 7,614,455 | B2 * | 11/2009 | Arvidson et al. | 169/15 |
| 7,849,871 | B2 * | 12/2010 | McLoughlin et al. | 137/87.02 |
| 8,286,719 | B2 * | 10/2012 | Vetesnik | 169/14 |
| 8,291,990 | B1 * | 10/2012 | Mohr | 169/12 |
| 8,307,907 | B2 * | 11/2012 | Laskaris et al. | 169/44 |
| 2003/0206805 | A1 * | 11/2003 | Bishop et al. | 417/44.2 |
| 2005/0034767 | A1 * | 2/2005 | Reimer et al. | 137/565.23 |
| 2007/0175513 | A1 | 8/2007 | McLoughlin | |
| 2007/0246230 | A1 * | 10/2007 | Roberts | 169/13 |
| 2009/0208346 | A1 | 8/2009 | McLoughlin | |
| 2011/0064591 | A1 | 3/2011 | McLoughlin | |
| 2012/0012344 | A1 | 1/2012 | McLoughlin | |
| 2012/0103639 | A1 * | 5/2012 | Rains et al. | 169/46 |
| 2013/0008518 | A1 | 1/2013 | McLoughlin | |
| 2013/0048318 | A1 * | 2/2013 | Ewers et al. | 169/46 |
| 2013/0098642 | A1 | 4/2013 | McLoughlin | |
| 2013/0105010 | A1 | 5/2013 | McLoughlin | |
| 2013/0105182 | A1 | 5/2013 | McLoughlin | |
| 2013/0253711 | A1 | 9/2013 | McLoughlin | |

* cited by examiner

HYDRAULIC SYSTEM AND METHOD FOR DELIVERING ELECTRICITY, WATER, AIR, AND FOAM IN A FIREFIGHTING APPARATUS

FIELD OF THE INVENTION

This invention relates generally to fire fighting apparatus and equipment, and in particular to a hydraulic system and method for delivering electricity, water, air, and foam in a firefighting apparatus.

BACKGROUND

In many applications it is required to supply electricity, water, air, and foam capability in a service apparatus. Firefighting apparatus and equipment such as fire trucks, fire boats, and like service equipment and vehicles often put high demands on the various subsystems of the apparatus. For example, conventional firefighting trucks may have trouble supplying sufficient horsepower to simultaneously generate electrical power and deliver chemical foam at a certain required flow rate.

BRIEF DESCRIPTION OF THE DRAWINGS

For a more complete understanding of the disclosure and the advantages thereof, reference is now made to the accompanying drawings, wherein similar or identical reference numerals represent similar or identical items.

DETAILED DESCRIPTION

Figure 1:
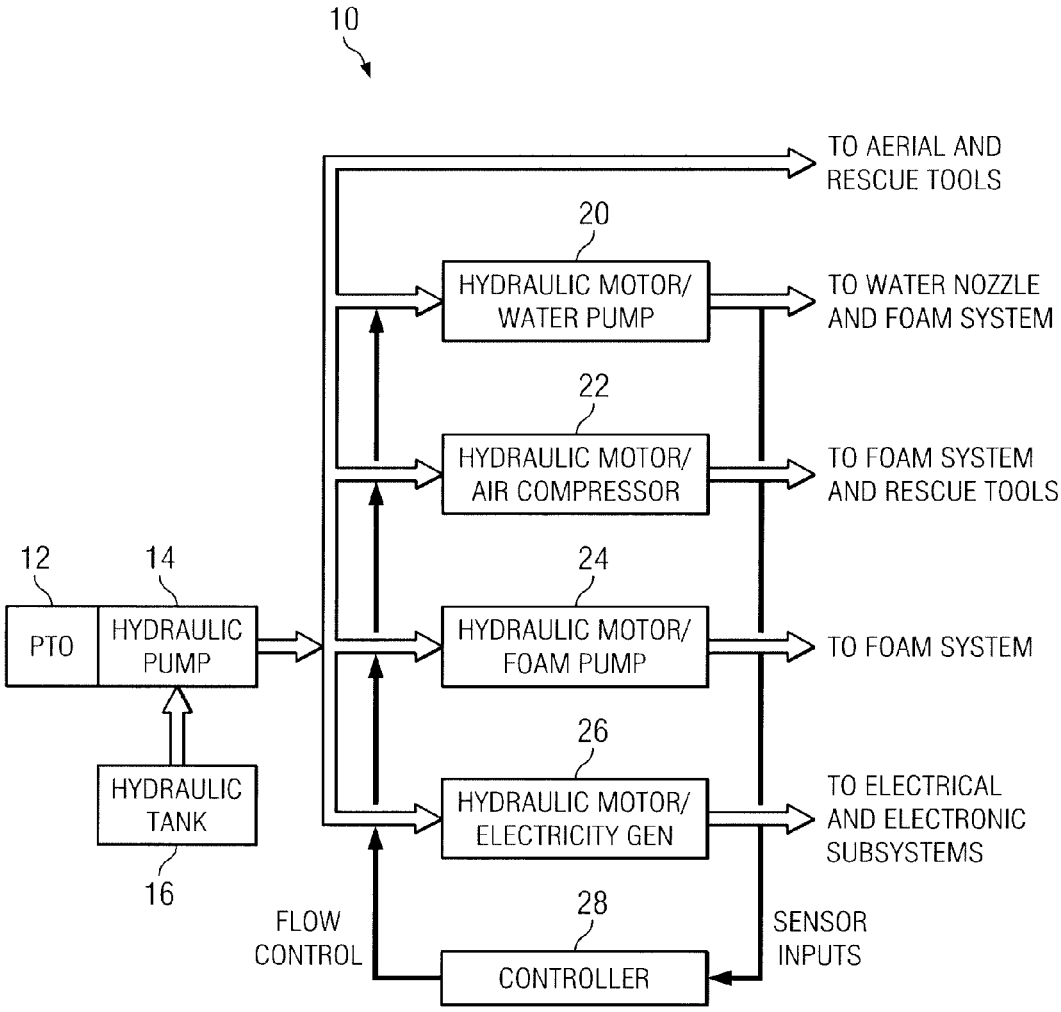
FIG. 1 is a logical block diagram according to one embodiment of the hydraulic system and method for delivering electricity, water, air and foam in a firefighting apparatus.

FIG. 1 is a logical block diagram according to one embodiment of the hydraulic system and method for delivering electricity, water, air and foam in a firefighting apparatus, referenced by numeral 10. A power-take-off (PTO) 12 or like device is operable to divert engine power from a drive axle (not shown) of the firefighting apparatus, such as a fire truck, and drive a hydraulic pump 14 in fluid communication with a hydraulic source 16, such as a hydraulic tank or reservoir. Hydraulic pump 14 supplies hydraulic fluid under pressure to a plurality of hydraulic lines leading from hydraulic pump 14 to several subsystems: a water pumping subsystem 20, an air compressor subsystem 22, a chemical foam subsystem 24, and an electrical power generator subsystem 26. Under the control of a microprocessor-based controller 28, which further monitors the flow rate and pressure of the various outputs from subsystems 20-26, system 10 is capable of delivering electricity, water, air, foam, as well as sufficient hydraulic pressure to operate an aerial and other rescue tools (not shown).

Figure 2:
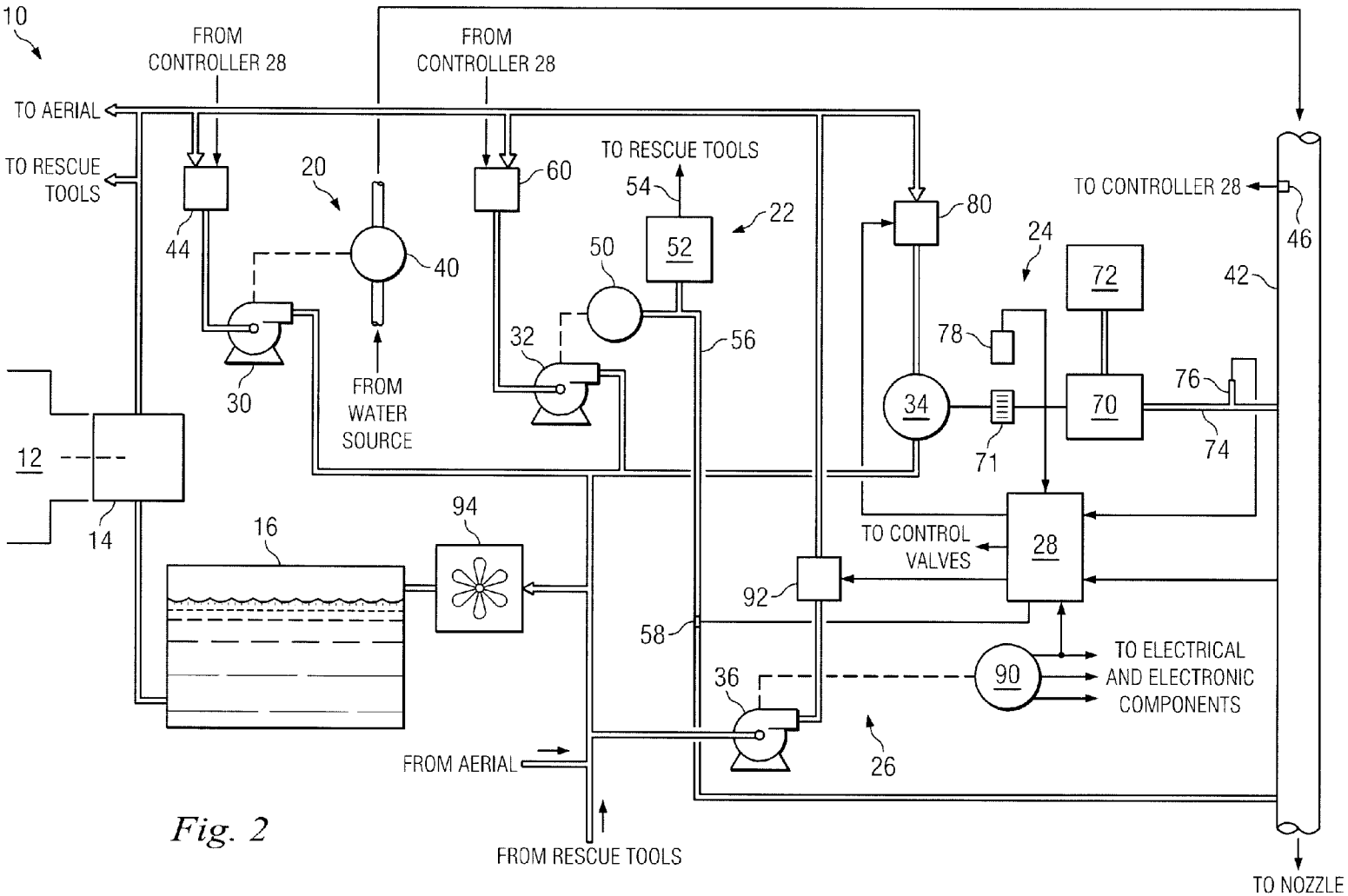
FIG. 2 is a more detailed block diagram according to one embodiment of the hydraulic system and method for delivering electricity, water, air and foam in a firefighting apparatus.

FIG. 2 is a more detailed block diagram according to one embodiment of the hydraulic system and method for delivering electricity, water, air and foam in a firefighting apparatus. As set forth above, PTO 12 drives hydraulic pump 14, which draws from hydraulic source 16, such as a tank. Hydraulic pump 14 simultaneously feeds pressurized hydraulic fluid to hydraulic motors 30-36 of water pumping subsystem 20, air compressor subsystem 22, chemical foam subsystem 24, and electrical power generator subsystem 26, respectively.

In water pumping subsystem 20, a water pump 40 is driven by the hydraulic fluid under pressure from hydraulic pump 14 via hydraulic motor 30. Water pump 40 causes water from a water source, which may be a hydrant or a reservoir, to be delivered, under pressure, to a conduit 42 that may lead to a hose and nozzle or another type of outlet (not shown). A control valve 44 receives one or more control signals from controller 28 to modulate the hydraulic pressure received by hydraulic pump 30, and thus the water flow rate from water pump 40. Further, a water flow sensor 46, such as a flowmeter, senses the flow rate of the water in conduit 42 and transmits this data to controller 28. Using data from water flow sensor 46 as well as controlling hydraulic flow using control valve 44, controller 28 is operable to control the speed of hydraulic motor 30 and the amount of water flow in conduit 42. One or more additional check valves, ball vales, control valves, and/or other types of valves as known in the art may be included in subsystem 20 but not shown for the sake of clarity. For example, one or more suitable valves may be included to prevent backflow.

In air compressor subsystem 22, an air compressor 50 is coupled to and driven by hydraulic motor 32. Air compressor 50 is operable to draw air from a source of air, such as an air compressor tank 52, and provide compressed air to an air line 56. Air line 56 is fed into conduit 42 via an injection device such as an air injection venturi and another suitable device. An air flow and pressure sensor 58, such as a transducer and the like, senses and measures the air flow and pressure and transmits this data to controller 28. A control valve 60 receives one or more control signals from controller 28 to modulate the hydraulic pressure received by hydraulic pump 32, and thus control the air flow rate from air compressor 50. Using data from air flow and pressure sensor 58 as well as controlling hydraulic flow using control valve 60, controller 28 is operable to control the speed of hydraulic motor 32 and the amount of air pressure and air flow in air line 56. Additionally, compressed air may be used to power certain rescue tools via air outlet 54 from air compressor tank 52.

In chemical foam subsystem 24, a foam pump 70 is coupled to and driven by hydraulic motor 34 via a gear wheel 71. Foam pump 70 is operable to draw a chemical foam from a source, such as a foam reservoir 72, and convey the foam to a conduit 74 coupled to conduit 42 to inject foam into conduit 42. Foam pump 70 may be any suitable pump such as a positive displacement pump. The amount of foam injected into conduit 42 may be determined by one of two ways. One, a foam flow sensor 76 senses the flow rate of the foam in conduit 74 and transmits this data to controller 28. Second, a speed sensor 78 senses the rate at which gear wheel 71 spins, and also transmits this data to controller 28. One or both of these foam flow rate sensing ways may be employed. A control valve 80 receives one or more control signals from controller 28 to modulate the hydraulic pressure received by hydraulic pump 34. Using data from speed sensor 78 and flow sensor 76 as well as controlling hydraulic flow using control valve 80, controller 28 is operable to control the speed of hydraulic motor 34 and the amount of foam being injected into conduit 42. As well known in the art, foam chemicals of the Class A or B type may be used with chemical foam subsystem 24. One or more additional check valves, ball vales, control valves, and/or other types of valves as known in the art may be included in subsystem 24 but not shown for the sake of clarity. For example, one or more suitable valves may be included to prevent backflow.

In electricity generation subsystem 26, a generator 90 coupled to and driven by hydraulic motor 36 generates and supplies AC and/or DC electrical power to the electrical and electronic components, such as controller 28, engine controllers and governors, sensors, instruments, climate control, lighting, communications, and other system components. A control valve 92 receives one or more control signals from controller 28 to modulate the hydraulic pressure received by hydraulic pump 36 and its speed. Subsystem 26 runs completely independently and the speed of generator 90 determines the frequency and voltage generated. Controller 28 is operable to monitor the electrical output of generator 90 and regulate the hydraulic pressure at hydraulic pump 36.

In addition to providing hydraulic pressure to drive water pumping subsystem 20, air compressor subsystem 22, chemical foam subsystem 24, and electrical power generator subsystem 26, hydraulic pump 14 driven by PTO 12 further supplies hydraulic fluid to drive the aerial apparatus and rescue tools (not shown) commonly equipped on a firefighting vehicle. These rescue tools may include cutters, spreaders, rams, and like equipment used to extricate victims trapped in automobiles or other structures. Hydraulic fluid is returned from the aerial, rescue tools, and hydraulic motors 30-36 to a hydraulic cooling system 94, which may include a fan and/or other cooling components as well known in the art. The cooled hydraulic fluid is then returned and stored in hydraulic reservoir 16.

In operation, the engine (not shown) runs at a preselected constant rpm by a governor (not shown), as well known in the art. The engine speed may range from idle to full speed. The speed of the engine and the gear ratios of PTO 12 are selected so that hydraulic pump 14 may provide maximum flow of hydraulic fluid required at peak demand. It is well known in the art that more than one hydraulic pump may be piggy-backed to provide sufficient hydraulic pressure and is therefore contemplated herein for certain applications. PTO 12 drives hydraulic pump 14 and supplies hydraulic fluid to water pumping subsystem 20, air compressor subsystem 22, chemical foam subsystem 24, and electrical power generator subsystem 26. Under the control of controller 28, which monitors the water flow rate, foam flow rate, and air pressure from sensors 46, 58, and 76, respectively, the hydraulic pressure of the hydraulic fluid supplied to each hydraulic pump 30-36 using control valves 44, 60, 80, and 92, respectively, is regulated. The speeds of hydraulic pumps 30-36 are thus controlled by controller 28, and the output flow rate from water pump 40, air compressor 50, foam pump 70, and generator 90 are also regulated.

The foam/water/air mix ratio is determined by the amount of water flowing in conduit 42, and the amount of foam and air being injected into conduit 42. Foam is injected into conduit 42 at a predetermined gallon per minute (GPM) rate and mixed with water to form a foam solution. Optionally, compressed air may be injected into conduit 42 to form a compressed air foam mixture. Controller 28 monitors the water flow rate, foam flow rate, and optionally the air pressure, and controls the speeds of hydraulic motors 30-36 to ensure the desired foam/water/air mix ratio is achieved and maintained. A user interface to controller 28 may enable a firefighter to selectively indicate whether Class A or Class B foam is being deployed in addition to one or more operating conditions to automatically set the desired foam flow rate, water flow rate, and air pressure to achieve the desired results. Safety features may be included to sense the foam level in foam reservoir and to shut off foam pump 70 and hydraulic pump 34 when the foam level drops too low.

It should be understood that flow rate sensors employed herein may be of any suitable technology and construction. Examples of flow rate sensors or flowmeters include paddle-wheel flowmeters, venture tubes, orifice plates, vortex meters, propeller meters, and the like without departing from the spirit or scope of the disclosed system and method.

It should be noted that control signals generated by controller 28 may be transmitted in a number of ways to control valves 44, 60, 80, and 92. For example, the transmission media may be wire or cabling, fiber optic, radio frequency (RF), infrared (IR), and the like.

Figure 3:
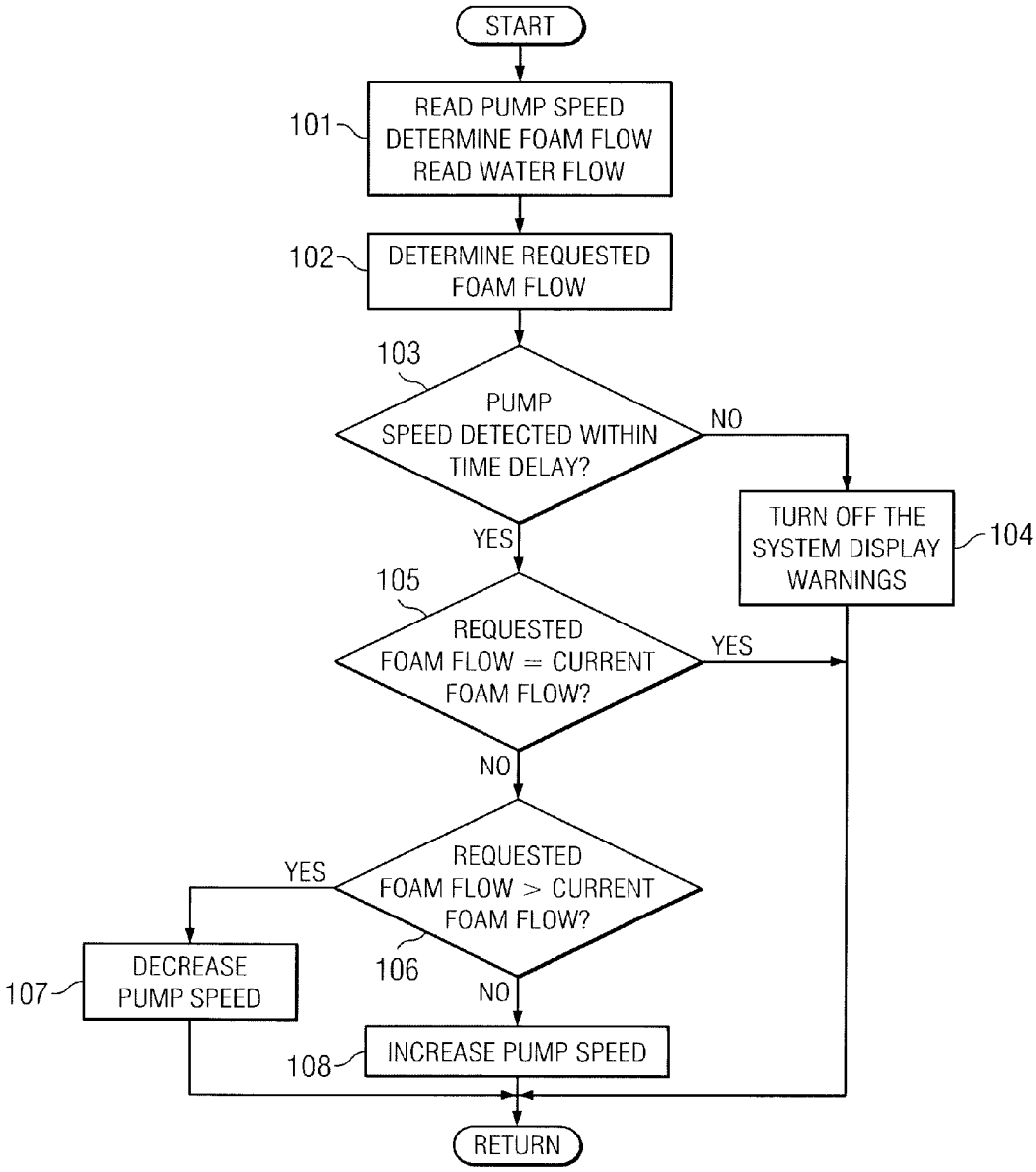
FIG. 3 is a flow diagram of one embodiment of a control process of a foam subsystem.

FIG. 3 is a flow diagram of one embodiment of a control process of chemical foam subsystem 24. Controller 28 reads the speed of foam pump 70, the water flow from water flow sensor 46, and determines the current actual foam flow rate in conduit 42 in block 101. Next, controller 28 determines the requested foam flow rate in block 102. In block 103, if controller 28 is unable to read the speed of foam pump 70 within a certain timeframe, controller 28 turns off foam system 24 and displays a warning on a user interface device or instrument panel in block 104. If controller 28 is able to read the speed of the foam pump, controller 28 compares the requested foam flow rate to the current measured foam flow rate in block 105. If the flow rates are not the same, controller 28 proceeds to block 106, where controller 28 increases or decreases the speed of the foam pump 70 shown in control blocks 107 and 108, depending on whether the current flow rate is greater or less than the requested foam flow rate. Methods for adjusting the speed of foam pump 70 are known to one skilled in the art and may include adjusting the speed of hydraulic motor 34 by altering the duty cycle of a pulse-width modulated hydraulic control valve, for example.

Figure 4:
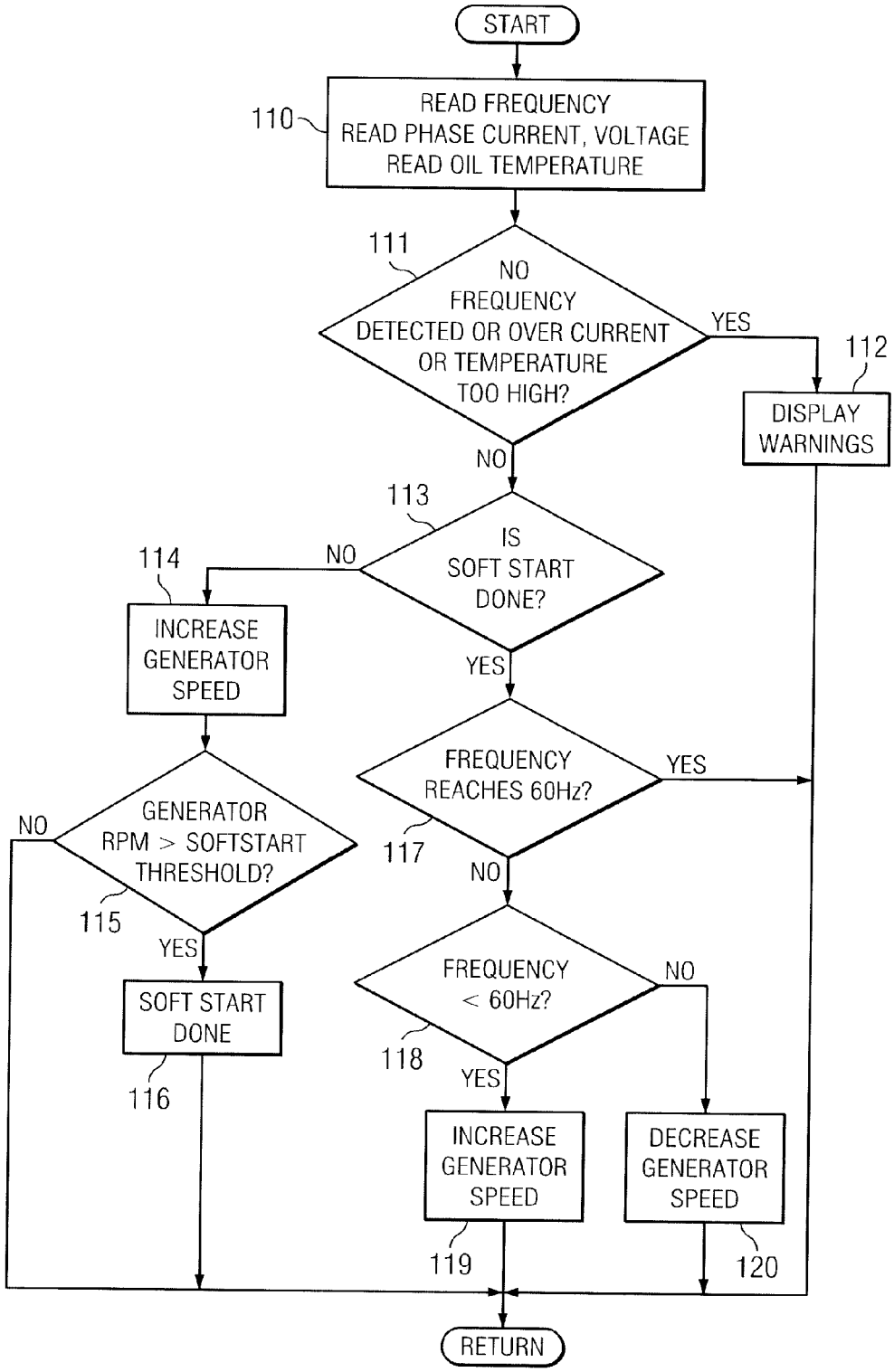
FIG. 4 is a flow diagram of one embodiment of a control process of an electricity generation subsystem.

FIG. 4 is a flow diagram of one embodiment of a control process of electricity generation subsystem 26. In block 110, controller 28 reads the frequency, phase current, voltage, and oil temperature of generator 90. Next, controller 28 detects error conditions, such as failure to detect a frequency, current above a limit, or temperature above a threshold in block 111. If an error condition is detected, an appropriate warning is displayed in block 112. In one embodiment, controller 28 is also capable of performing a soft start. A soft start gradually increases the hydraulic load on a system to avoid a hydraulic shock which may result from a sudden and dramatic change in load. After determining that no error condition is present, if electricity generation subsystem 26 is in soft start mode, as determined in block 113, the speed of generator 90 is increased in block 114. Controller 28 then determines whether the speed of generator 90 meets the soft start threshold in block 115. If so, then the soft start is completed in block 116.

When electricity generation subsystem 26 is not in soft start mode, after determining that no error condition is present, controller 28 determines whether the generator frequency is 60 Hz in block 117. If the frequency is not 60 Hz, the process proceeds to block 118, wherein the controller 28 determines whether the frequency is less than or greater than 60 Hz. The speed of generator 90 is increased or decreased in blocks 119 or 120 accordingly. Methods for adjusting the speed of generator 90 are known to one skilled in the art and may include adjusting the speed of hydraulic motor 34 by altering the duty cycle of a pulse-width modulated hydraulic control valve.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various methods, techniques, or elements may be combined or integrated in another system, or certain features may be omitted or not implemented.

What is claimed is:

1. A firefighting apparatus comprising:

a controller;

a hydraulic pump operable to supply a hydraulic fluid under pressure;

a water pumping subsystem comprising:

a first hydraulic motor powered by the hydraulic fluid under pressure;

a water pump driven by the first hydraulic motor operable to supply water under pressure to a conduit;

a water flow sensor configured to determine a flow rate of water in the conduit and provide the flow rate to the controller; and a first control valve under the control of the controller to regulate the hydraulic fluid input to the first hydraulic motor and the water flow rate;

a chemical foam subsystem comprising:

a second hydraulic motor powered by the hydraulic fluid under pressure;

a foam pump driven by the second hydraulic motor operable to inject foam into the conduit;

a foam flow sensor configured to determine a flow rate of foam from the foam pump and provide the flow rate to the controller; and a second control valve under the control of the controller to regulate the hydraulic fluid input to the second hydraulic motor and the foam flow rate;

an electrical power generator subsystem comprising:

a third hydraulic motor powered by the hydraulic fluid under pressure;

a generator driven by the third hydraulic motor operable to generate electrical power;

a third control valve under the control of the controller to regulate the hydraulic fluid input to the third hydraulic motor; and the controller monitoring the electrical power output from the generator to control the third control valve;

an air compressor subsystem comprising:

a fourth hydraulic motor powered by the hydraulic fluid under pressure;

an air compressor driven by the fourth hydraulic motor operable to supply compressed air to an air line coupled to the conduit;

an air pressure sensor configured to determine a pressure of air in the air line and provide the air pressure to the controller; and a fourth control valve under the control of the controller to regulate the hydraulic fluid input to the fourth hydraulic motor and the air pressure in the air line;

a hydraulic fluid cooling device receiving and cooling hydraulic fluid returned from the first, second, third, and fourth hydraulic motors; and a hydraulic reservoir storing the cooled hydraulic fluid.

2. The firefighting apparatus of claim 1, wherein the hydraulic fluid under pressure from the hydraulic pump is further supplied to power aerial equipment.

3. The firefighting apparatus of claim 1, wherein the hydraulic fluid under pressure from the hydraulic pump is further supplied to power rescue tool equipment.

4. The firefighting apparatus of claim 1, further comprising a nozzle coupled to the conduit for delivering a solution selected from the group consisting of water, water/foam, and water/foam/air.

5. The firefighting apparatus of claim 1, wherein the controller is operable to determine and control the desired foam-to-water-to-air mix ratio of a solution delivered in the conduit.

6. A firefighting system comprising:

a controller;

a hydraulic pump operable to supply a hydraulic fluid under pressure;

a water pumping subsystem comprising:

a first hydraulic motor powered by the hydraulic fluid under pressure;

a water pump driven by the first hydraulic motor operable to supply water under pressure to a conduit;

a water flow sensor configured to determine a flow rate of water in the conduit and provide the flow rate to the controller; and a first control valve under the control of the controller to regulate the hydraulic fluid input to the first hydraulic motor and the water flow rate;

a chemical foam subsystem comprising:

a second hydraulic motor powered by the hydraulic fluid under pressure;

a foam pump driven by the second hydraulic motor operable to inject foam into the conduit;

a foam flow sensor configured to determine a flow rate of foam from the foam pump and provide the flow rate to the controller; and a second control valve under the control of the controller to regulate the hydraulic fluid input to the second hydraulic motor and the foam flow rate;

an electrical power generator subsystem comprising:

a third hydraulic motor powered by the hydraulic fluid under pressure;

a generator driven by the third hydraulic motor operable to generate electrical power;

a third control valve under the control of the controller to regulate the hydraulic fluid input to the third hydraulic motor; and the controller monitoring the electrical power output from the generator to control the third control valve;

a hydraulic fluid cooling device receiving and cooling hydraulic fluid returned from the first, second, third, and fourth hydraulic motors; and a hydraulic reservoir storing the cooled hydraulic fluid.

7. The firefighting system of claim 6, comprising:

an air compressor subsystem comprising:

a fourth hydraulic motor powered by the hydraulic fluid under pressure;

an air compressor driven by the fourth hydraulic motor operable to supply compressed air to an air line coupled to the conduit;

an air pressure sensor configured to determine a pressure of air in the air line and provide the air pressure to the controller; and a fourth control valve under the control of the controller to regulate the hydraulic fluid input to the fourth hydraulic motor and the air pressure in the air line.

8. The firefighting system of claim 6, wherein the hydraulic fluid under pressure from the hydraulic pump is further supplied to power aerial equipment.

9. The firefighting system of claim 6, wherein the hydraulic fluid under pressure from the hydraulic pump is further supplied to power rescue tool equipment.

10. The firefighting system of claim 7, further comprising a nozzle coupled to the conduit for delivering a solution selected from the group of water, water/foam, and water/foam/air.

11. The firefighting system of claim 7, wherein the controller is operable to determine and control the desired foam-to-water-to-air mix ratio of a solution delivered in the conduit.

* * * * *